US005888150A

United States Patent [19]

Young

[11] Patent Number: 5,888,150

[45] Date of Patent: Mar. 30, 1999

[54] GOLF BALL

[76] Inventor: James A. Young, 805 N. Langham Ave., Covina, Calif. 91724

[21] Appl. No.: 859,279

[22] Filed: May 19, 1997

[51] Int. Cl.[6] ..... A63B 37/06; A63B 37/14

[52] U.S. Cl. ..... 473/356; 473/365; 473/378; 473/383; 273/DIG. 20; 33/508; 33/555.1; 33/550; 33/783

[58] Field of Search ..... 473/378, 365, 473/383, 356; 273/232, DIG. 20; 33/508, 555.1, 555.2, 555.3, 555.4, 550, 567, 783

[56] References Cited

U.S. PATENT DOCUMENTS 4,653,758 3/1987 Solheim ..... 473/383 X 5,470,075 11/1995 Nesbitt et al. ..... 473/378 X

OTHER PUBLICATIONS

"Capital City Federal Home Owner", Jul.–Aug. 1972 Published by Capital City Federal Savings and Loan Association of Washington, D.C.

*Primary Examiner*—George J. Marlo

[57] ABSTRACT

A golf ball having a would center and a dimple less outer surface having a constant diameter of 1.75 inches and a smoothness which is determined by rolling a golf ball between upper and lower parallel glass plates supported by four support legs and monitoring any changes in an amount of forced needed to roll the ball between the plates for detecting the presence of an imperfection upon the surface of the ball or an out-of-round ball.

1 Claim, 2 Drawing Sheets

FIG. 1
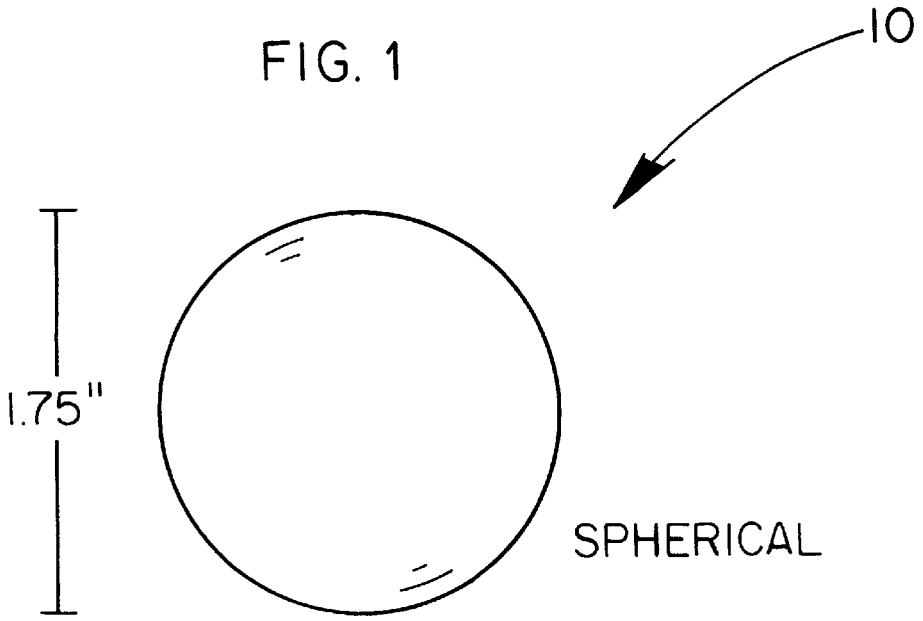
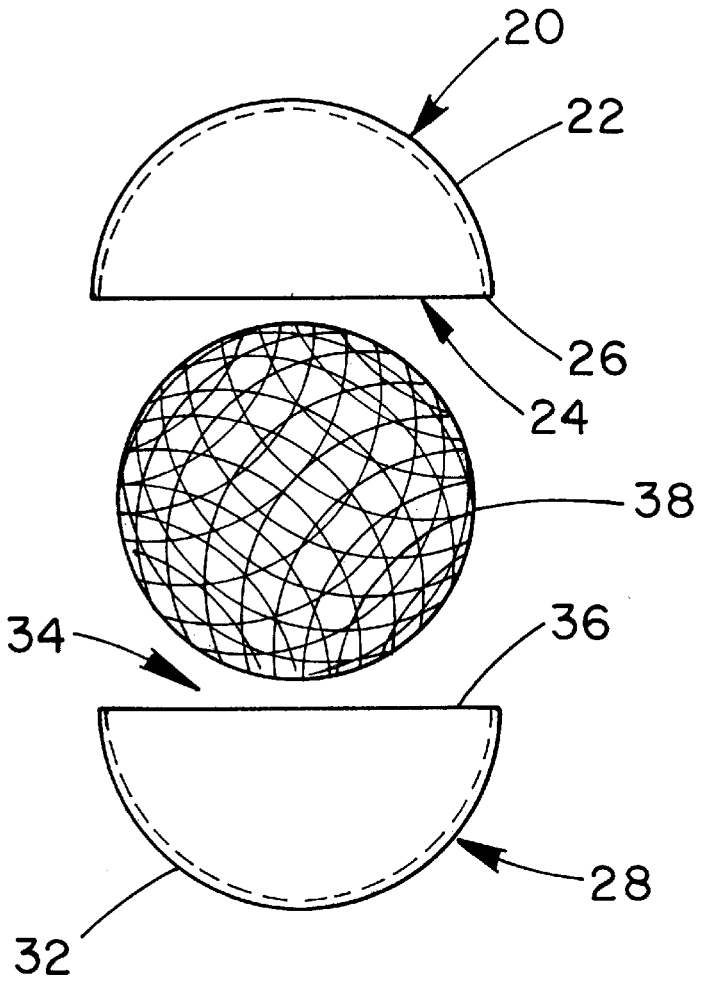
FIG. 2

GOLF BALL

BACKGROUND OF THE INVENTION

1. Field of the Invention

The present invention relates to a golf ball and more particularly pertains to a golf ball which does not utilize dimples.

2. Description of the Prior Art

The use of a golf balls is known in the prior art. More specifically, golf balls are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,308,076 to Sun; U.S. Pat. No. 4,266,773 to Treadwell; Des. Pat. No. 355,943 to Cadorniga; U.S. Pat. No. 4,804,189 to Gobush; U.S. Pat. No. 5,087,048 to Sun and U.S. Pat. No. 5,060,953 to Bunger all disclose golf balls with dimple patterns.

In this respect, the golf ball of the present invention substantially departs from the conventional concepts and designs of the prior art, and in so doing provides an apparatus primarily developed for the purpose of increasing the playing characteristics of a golf ball.

Therefore, it can be appreciated that there exists a continuing need for golf balls of enhanced playing characteristics. In this regard, the present invention substantially fulfills this need.

SUMMARY OF THE INVENTION

In view of the foregoing disadvantages inherent in the known types of golf balls now present in the prior art, the present invention provides a golf ball with increased playing characteristics. As such, the general purpose of the present invention, which will be described subsequently in greater detail, is to provide a dimpleless golf ball which will provide for straighter drives and putts.

The present invention relates to a new and improved golf ball comprising a top hemisphere having an outer surface, a hollow interior and a peripheral edge. A bottom hemisphere is included having an outer surface, a hollow interior and a peripheral edge. A core of a wound compressible material, is adapted to be positioned intermediate the top hemisphere and the bottom hemisphere with the bottom and top hemispheres being joined along their peripheral edges. This top hemisphere is defined by an outer smooth surface. The bottom hemisphere likewise is defined by an outer smooth surface. When joined, the bottom and top hemispheres define a perfectly smooth spherical golf ball which has a diameter of 1.75 inches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dimpleless golf ball construction.

It is another object of the present invention to provide a golf ball with enhanced playing characteristics.

It is a further object of the present invention to provide a means of testing a golf ball construction in accordance with the principles of the present invention.

An even further object of the present invention is to provide a golf ball which is susceptible of a low cost of manufacture with regard to both materials and labor, and which accordingly is then susceptible of low prices of sale to the consuming public, thereby making such a golf ball economically available to the buying public.

Still yet another object of the present invention is to provide a golf ball which provides in the apparatuses and methods of the prior art some of the advantages thereof, while simultaneously overcoming some of the disadvantages normally associated therewith.

Lastly, it is an object of the present invention to provide a new and improved golf ball comprising a top hemisphere having an outer surface, a hollow interior and a peripheral edge, a bottom hemisphere having an outer surface, a hollow interior and a peripheral edge. Furthermore the golf ball includes a core of a compressible material, wherein the core is adapted to be positioned intermediate the top hemisphere and the bottom hemisphere, the bottom and top hemispheres being joined along their peripheral edges. The top hemisphere is defined by an outer smooth surface. The bottom hemisphere is likewise defined by an outer smooth surface. When joined, the bottom and top hemispheres define a perfectly smooth spherical golf ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 a view of a golf ball constructed in accordance with the principles of the present invention.

FIG. 2 is an exploded view of the golf ball of the present invention.

Similar reference characters refer to similar parts throughout the several views of the drawings.

DESCRIPTION OF THE PREFERRED EMBODIMENT

Figure 3:
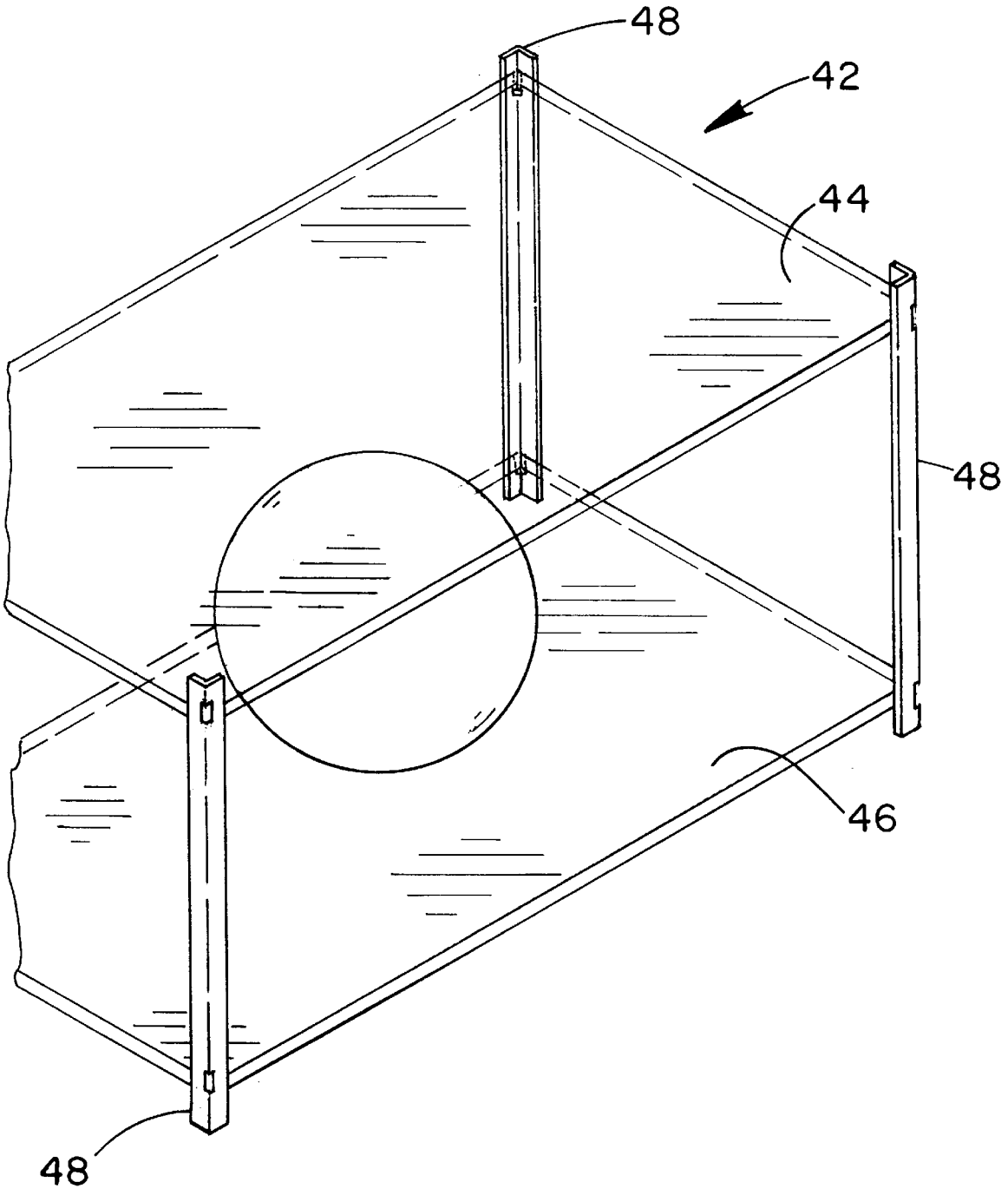
FIG. 3 a perspective view of the testing apparatus employed in conjunction with the present invention.

With reference now to the drawings, and in particular to FIG. 1 thereof, a golf ball designed in accordance with the present invention is illustrated. Namely, FIG. 1 illustrates a dimpleless golf ball 10. The present invention will be described in greater detail hereinafter.

The present invention relates to a new and improved golf ball which utilizes no dimples. This golf ball 10 is constructed from a top and bottom hemisphere with an intermediate core of elastic material. The top hemisphere 20, as is illustrated in FIG. 2, is defined by an outer surface 22, a hollow interior 24 and a peripheral edge 26. Likewise, the bottom hemisphere 28, again as illustrated in FIG. 2, is defined by an outer surface 32, a hollow interior 34 and a peripheral edge 36.

The present invention utilizes an intermediate core of compressible material 38. In the preferred embodiment this core is of a wound compressible material. Such a core of wound material is depicted in FIG. 2. The core 38 is adapted to be positioned intermediate the top hemisphere 20 and the bottom hemisphere 28. Although, a wound core has been described other compressible cores are contemplated, such as elastomeric cores or liquid cores. The compressible core 38 is sealed within the golf ball when the bottom and top hemispheres are joined along their peripheral edges 26 and 36 respectively. This construction is best illustrated with reference to FIG. 2. The golf ball of the present invention is characterized in that it is smooth. Thus, the top hemisphere 20 is defined by an outer smooth surface and the bottom hemisphere 28 is likewise defined by an outer smooth surface. When joined, the bottom and top hemispheres 20 and 28 define a perfectly smooth spherical golf ball 10. In the preferred embodiment this golf ball has constant diameter of 1.75 inches.

The present invention also relates to a method of testing the smoothness and roundness of a golf ball made in accordance with the present invention. This testing method 42 employs a testing apparatus which includes upper and lower glass plates, 44 and 46 respectively. These plates are separated from one another by four support legs 48. These legs 48 provide for adjusting the distance between the top and bottom glass plates 44 and 46. At the same time the support legs 48 ensure that the upper and lower glass plates 44 and 46 remain at a fixed distance from one another. In testing a golf ball made in accordance with the principles of the present invention, the golf ball in positioned inbetween the two glass plates. The plates are adjusted such that the upper plate lightly contacts the upper surface of the golf ball. This contact should be light enough to allow the golf ball to roll in between the two plates. Any changes in the amount of force needed to roll the ball in between the plates will be the result of imperfection upon the surface of the ball or an out-of-round ball.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball comprising in combination:

a top hemisphere having an outer surface, a hollow interior and a peripheral edge;

a bottom hemisphere having an outer surface, a hollow interior and a peripheral edge;

a core of a wound compressible material, the core positioned intermediate the top hemisphere and the bottom hemisphere, the bottom and top hemispheres being joined along their peripheral edges;

the top hemisphere being defined by an outer smooth and dimpleless surface;

the bottom hemisphere being defined by an outer and dimpleless smooth surface;

said bottom and top hemispheres defining a perfectly smooth, dimpleless and spherical golf ball having a constant diameter of 1.75 inches as determined by roundness measuring steps including providing a testing apparatus including upper and lower glass plates separated from one another by four support legs for adjusting a distance between the top and bottom glass plates and further ensuring that the upper and lower glass plates remain at a fixed distance from one another;

positioning the golf ball in between the two glass plates;

adjusting the upper plate until the same lightly contacts the surface of the golf ball and allowing the golf ball to roll in between the two plates; and monitoring any changes in an amount of force needed to roll the ball in between the plates for detecting the presence of an imperfection upon the surface of the ball or an out-of-round ball.

* * * * *